United States Patent [19]

Nozawa

[11] Patent Number: 4,628,787

[45] Date of Patent: Dec. 16, 1986

[54] SOUND SOURCE APPARATUS

[75] Inventor: Yasuo Nozawa, Kawasaki, Japan

[73] Assignee: The Daiei, Inc., Kobe, Japan

[21] Appl. No.: 666,226

[22] Filed: Oct. 29, 1984

[30] Foreign Application Priority Data

Oct. 28, 1983 [JP] Japan ..... 58-200831

[51] Int. Cl.[4] ..... G10H 1/02; G10H 1/06

[52] U.S. Cl. ..... 84/1.2; 84/1.22; 84/1.26

[58] Field of Search ..... 84/1.01, 1.19–1.23, 84/1.26

[56] References Cited

U.S. PATENT DOCUMENTS 4,388,849 6/1983 Hamada ..... 84/1.01 X 4,461,199 7/1984 Hiyoshi et al. ..... 84/1.19

4,478,124 10/1984 Kikumoto ..... 84/1.19

4,483,229 11/1984 Tsukamoto et al. ..... 84/1.01

4,536,853 8/1985 Kawamoto et al. ..... 84/1.01 X 4,538,495 9/1985 Sato ..... 84/1.19

*Primary Examiner*—S. J. Witkowski

*Attorney, Agent, or Firm*—Spencer & Frank

[57] ABSTRACT

Disclosed is a sound source apparatus which is composed of a plurality of sound component pattern generators each capable of providing a predetermined pattern, and a sound component picking circuit for sweeping the plurality of sound component pattern generators repeatedly in such a rapid sequence that the sound component thus provided and taken may constitute a musical sound at a desired pitch.

5 Claims, 9 Drawing Figures

SOUND SOURCE APPARATUS

BACKGROUND OF THE INVENTION

This invention relates to a sound source apparatus capable of generating a desired tone and producing a musical sound fairly close to the natural sound produced by a musical instrument.

A variety of ways of producing artificial sounds have been hitherto proposed. According to one of these conventional sound generating ways a sinusoidal fundamental wave and its harmonic waves are generated and these waves are selectively combined with each other to produce a desired tone. According to another conventional way a sawtooth or square wave containing a great number of harmonic waves is generated, and selected harmonic waves are eliminated from the sawtooth or square wave to simulate a desired tone. According to still another conventional way a variety of sound waves are stored and are selectively used. These conventional methods, however, produce sounds of fixed waveforms, and therefore the resultant tone causes a somewhat stiff sensation in the ear. In an attempt to produce profound, rich artificial tones, in the first conventional method the selected harmonic to fundamental wave ratio is varied with time; in the second conventional method the characteristics of filters are varied with time, thereby changing harmonic contents with time; and in the third and final conventional method the mixing ratio of different sound waves is varied, or otherwise the speed at which sound waves are picked is varied with time.

Electronic musical instruments and synthesizers produce different tones in such ways as mentioned above. In case of adding the fundamental wave and its harmonic waves to each other, or in case of subtracting harmonics from a given waveform it is difficult to produce different tones or sounds such as would be produced by different types of musical instruments, and there is the tendency of producing noise in the course of addition or subtraction proceedings, and deteriorating the sound quality. Also, there is a problem of difficulty in producing a delicate or characteristic variation of sound, such as an impressive sensation in the ear at the beginning part of a blow on the trumpet.

OBJECTS AND SUMMARY OF THE INVENTION

With a view to overcoming the defects described above with reference to the conventional methods of producing artificial sounds, a sound source apparatus is proposed by the inventor, and it is capable of generating a desired tone with ease, and is capable of producing musical sounds fairly close to natural ones produced by corresponding musical instruments.

A sound source apparatus according to this invention comprises a plurality of sound component pattern generators and a sound component picking circuit for sweeping and taking sound component signals from said sound component pattern generators, thereby constituting a desired tone fairly close to the natural tone produced by a musical instrument.

First, the priniciple of this invention is described with reference to FIGS. 1A and 1B.

FIG. 1A shows three different waveforms A, D and R representing sound waves for the sound "C" produced by a piano. Specifically, waveform A represents the sound "C" at the attack portion; waveform D represents the sound "C" at the decay portion; and waveform "R" represents the sound "C" at the release portion. FIG. 1B shows three different waveforms PGx, PGy and PGz representing sound component patterns generated by three different sound component pattern generators $PG_1$, $PG_2$ and $PG_3$. The sound component pattern PGx is composed by sampling each of subsequent waveforms A, D and R at a phase point as indicated by arrow PGx, and arranging the so sampled portions $a_1$, $a_2$ and $a_3$ in time. Likewise, the sound component pattern PGy is composed by sampling each of subsequent waveforms A, D and R at a phase point as indicated by arrow PGy, and arranging the so sampled portions $b_1$, $b_2$ and $b_3$ in time. The sound component pattern PGz is composed by sampling waveforms A, D and R at a phase point as indicated by arrow PGz, and arranging the so sampled portions $c_1$, $c_2$ and $c_3$ in time. These sound component patterns PGx, PGy and PGz are stored in the sound component pattern generators $PG_1$, $PG_2$ and $PG_3$ respectively. These generators may be composed of a register. In synthesizing a desired tone from the sound component patterns a sound component picking circuit sweeps the generators $PG_1$, $PG_2$ and $PG_3$ one after another to take sound components $a_1$, $b_1$ and $c_1$, thereby reproducing the sound waveform A. The generators $PG_1$, $PG_2$ and $PG_3$ are swept repeatedly to reproduce the sound waveforms D and R. As is apparent from the above, the reproduced waveform gets closer to the natural sound waveform as the sampling times increase, and there must be provided as many sound component pattern generators as the sampling times.

DESCRIPTION OF THE PREFERRED EMBODIMENTS

Figure 1A:
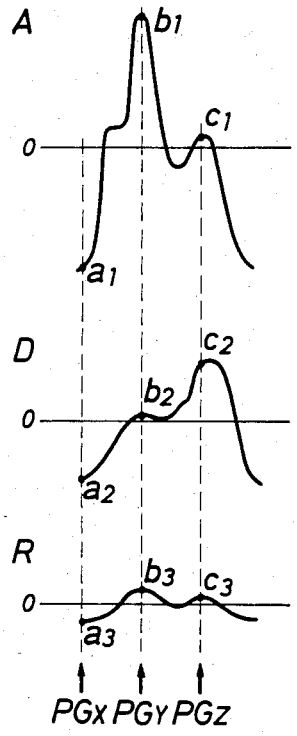
FIGS. 1A and 1B show waveforms representing sound waves for a particular sound produced by a musical instrument and waveforms representing sound component patterns respectively.
Figure 1B:
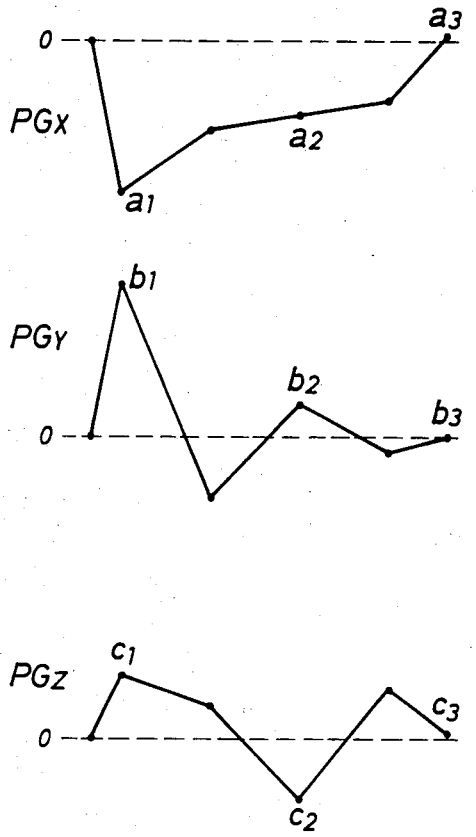
Figure 2:
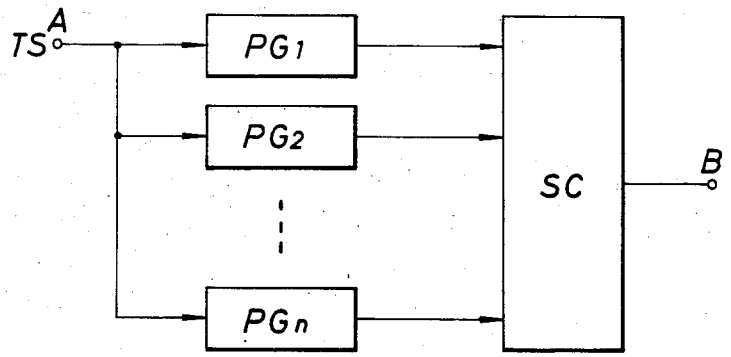
FIG. 2 shows a schematic block diagram representing the principle of this invention.
Figure 4:
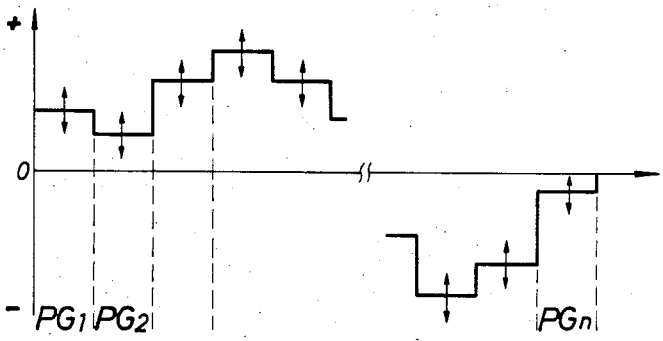
FIG. 4 shows a waveform representing an output signal from the sound component picking circuit.

FIG. 2 is a block diagram representing the basic structure of a sound source apparatus according to this invention. As shown in the drawing the sound source apparatus comprises a parallel connection of generators $PG_1$, $PG_2$, . . . $PG_n$ each capable of generating a sound component pattern and a sound component picking circuit SC connected to the output terminals of the sound component pattern generators for taking sound components from the sound component pattern generators and arranging these sound components one after another, thereby providing a synthetic sound wave fairly close to the one produced by a musical instrument. The sound components thus selected by the sound component picking circuit SC are shown in FIG. 4, and each sound component changes as indicated by an arrow in the drawing.

Figure 3A:
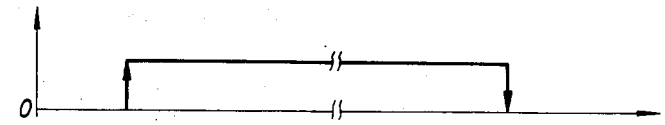
FIGS. 3A and 3B show waveforms representing a trigger signal and a sound component pattern respectively.
Figure 3B:
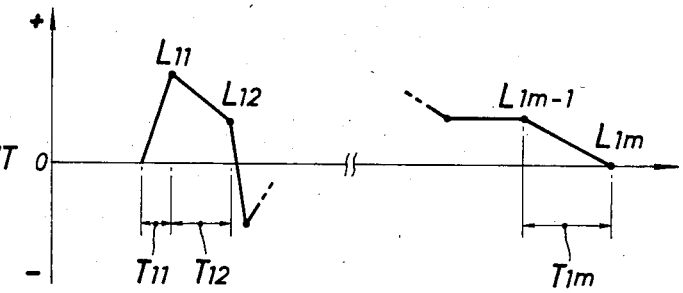

As described earlier, the generator $PG_1$ is capable of providing a sound component pattern, for instance, rising up to a level $L_{11}$ in time $T_{11}$, decreasing to a level $L_{12}$ in time $T_{12}$, decreasing still further to a level $L_{13}$ in time $T_{13}$ and so forth and finally reaching level $L_{1m}$ in time $T_{1m}$. Likewise, the generator $PG_2$ is capable of generating another sound component pattern varying with time, as for instance as follows: it reaches level $L_{21}$ in time $T_{21}$, level $L_{22}$ in time $T_{22}$ and so forth, and finally level $L_{2m}$ in $T_{2m}$. The other generators are capable of providing different sound component patterns. For instance the generator $PG_n$ provides a sound component pattern varying as follows: it reaches $L_{n1}$ in time $T_{n2}$, $L_{n2}$ in time $T_{n2}$ and so forth, and finally $L_{nm}$ in time $T_{nm}$. These time parameter T ($T_{11}$, $T_{12}$, . . . $T_{1m}$; $T_{21}$, $T_{22}$, . . . $T_{2m}$; . . . $T_{n1}$, $T_{n2}$, . . . $T_{nm}$) and level parameter L ($L_{11}$, $L_{12}$, . . . $L_{1m}$; $L_{21}$, $L_{22}$, . . . $L_{2m}$; $L_{n1}$, $L_{n2}$, . . . $L_{nm}$) are fixed at different values in different generators. FIGS. 3A and 3B show how a generator provides a sound component pattern. Assume that a trigger signal TS (FIG. 3A) is applied to a trigger terminal A of the sound source apparatus. The generator $PG_1$ provides a sound component pattern which varies with time as shown in FIG. 3B. Likewise, the other generators $PG_2$ and $PG_n$ provide different sound component patterns. When the trigger signal TS returns to zero, the signals appearing at the output terminals of the generators return to zero.

As mentioned earlier, the sound component picking circuit SC is capable of picking up selected sound components appearing at the terminals of the generators repeatedly in rapid sequence.

The resultant composite sound wave is composed of sequential sound components each picked up from the output signals from the generators. As is readily understood, the composite sound wave signal appearing at the output terminal of the sound component picking circuit SC depends on the level and time parameters $L_{11}$ to $L_{nn}$ and $T_{11}$ to $T_{nn}$ in the sound component pattern generators $PG_1$, $PG_2$, . . . $PG_n$. Therefore, if the level and time parameters in the sound component generators are set at values appropriate for constituting a synthetic sound possibly closest to the sound produced by a natural musical instrument, and if the switching frequency in the sound component picking circuit is set at a value appropriate for providing the frequency of the musical sound, the waveform of the resultant sound signal appearing at the output terminal of the sound component picking circuit SC will be closest to the waveform of the sound generated by the musical instrument. Thus, the resultant sound signal will be able to generate the same tone as the natural sound. A desired tone can be simulated by changing the level and time parameters in the sound component pattern generators so as to copy the natural tone. Thus, no matter what tone or complicated sound may be desired, the sound source apparatus according to this invention can meet such demand with ease.

Figure 5:
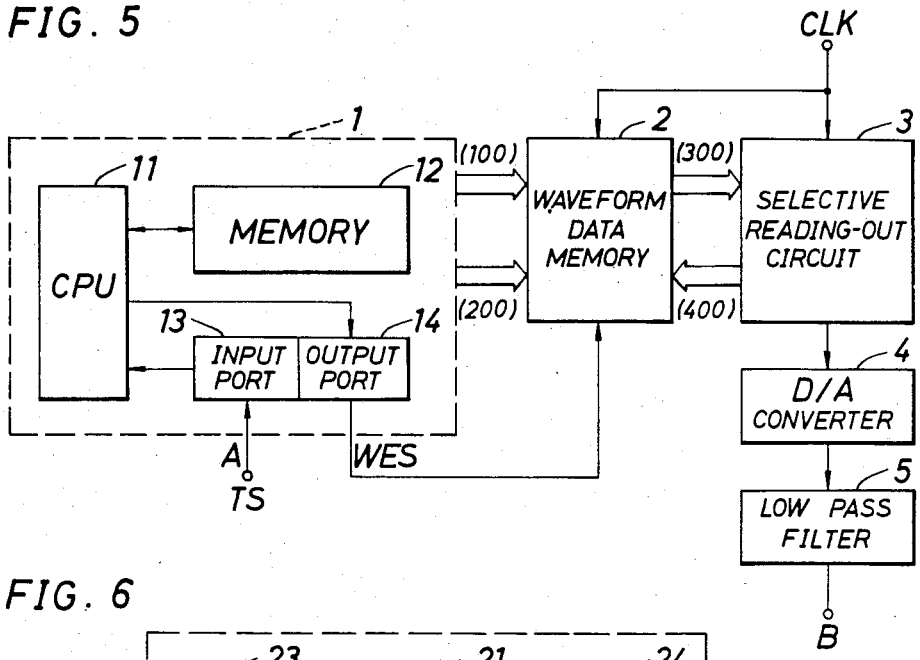
FIG. 5 shows a schematic block diagram of a sound source apparatus according to one embodiment of this invention.
Figure 6:
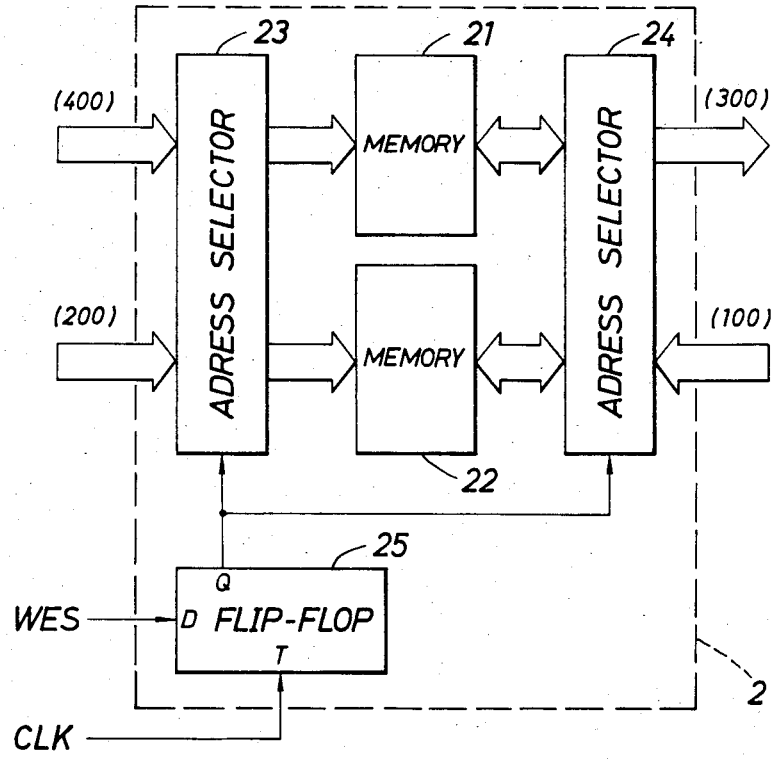
FIG. 6 shows a schematic block diagram of a waveform data memory appearing in FIG. 5.

FIG. 5 shows a circuit diagram of a sound source apparatus according to one embodiment of this invention. In FIG. 5, a microprocessor unit 1 includes a central processing unit (CPU) 11, a memory 12 for storing operation programs and parameters of the sound component pattern generators, an input port 13 for applying trigger signals TS, and an output port 14 for outputting "writing end" signal WES. A waveform data memory 2 is connected to the microprocessor unit 1 by data bus 100 and address bus 200, and is used for storing data on waveforms supplied by the microprocessor unit 1. As shown in FIG. 6 this waveform data memory 2 is composed of two memories 21 and 22, thereby permitting the simultaneous reading and writing of data, an address selector 23 for alternately selecting address buses, another address selector 24 for alternately selecting data buses, and a "D" flip-flop 25 for controlling the switching action of each selector. Specifically, each selector is responsive to the signal appearing at the "Q" output terminal of the "D" flip-flop 25 in such a way that the address selector 23 selects one of the memories 21 and 22 for storing data, and at the same time the address selector 24 selects the other memory for taking out data, and vice versa.

Again referring to FIG. 5, a selective reading-out circuit 3 is connected to the waveform data memory 2 with data bus 300 and address bus 400 for selectively reading data from the memories 21 and 22 of the waveform data memory 2. A digital-to-analog converter 4 is connected to the selective reading-out circuit 3, and a low-pass filter 5 is connected to the digital-to-analog converter 4.

In operation the memories 21 and 22 together constituting the waveform memory 2 are switched therebetween as follows: the instant that a periodic amount of waveform data supplied from the microprocessor unit 1 (that is, a synthetic waveform resulting from sequential sound components taken from the sound component patterns provided by the generators $PG_1$, $PG_2$, . . . $PG_n$) has been put in one of the memories, say memory 21, a writing end signal WES appears at the output port 14 of the microprocessor unit 1. Thereafter, at the leading edge of a clock signal CLK a "Q" output signal from the flip-flop 25 is applied to the data selector 23, and then the data selector 23 selects the other memory, say memory 22 so that another periodic amount of waveform data is directed to the memory 22 for storing therein. At the same time the data selector 24 is switched so that the waveform data is read out from the memory 21. When the writing of the waveform into the other memory 22 has finished, a writing end signal WES appears at the output port 14 of the microprocessor unit 1. Then, the writingand-reading switching performance is conducted in the opposite way to the above.

Every time a trigger signal TS is applied to the input terminal A, and hence the input port 13, the writing of waveform data from the microprocessor unit 1 into either memory 21 or 22 and the selective reading of waveform data at a rate appropriate for obtaining the frequency of musical sound are repeated. The sound component patterns vary with the parameters $T_1$, $T_2$, . . . Tn and $L_1$, $L_2$, . . . Ln stored in the memory 12 of the microprocessor unit 1, and accordingly a periodic amount of waveform varies with time. The parameters stored in the memory 12 of the microprocessor unit 1 can be varied with ease, and if the memory 12 has a large capacity enough to store a plurality of sets of parameters, according to an appropriate software in response to a switching signal from the input port 13 of the microprocessor unit 1 the plurality of sets of parameters are selected to constitute a desired tone with ease.

Figure 7:
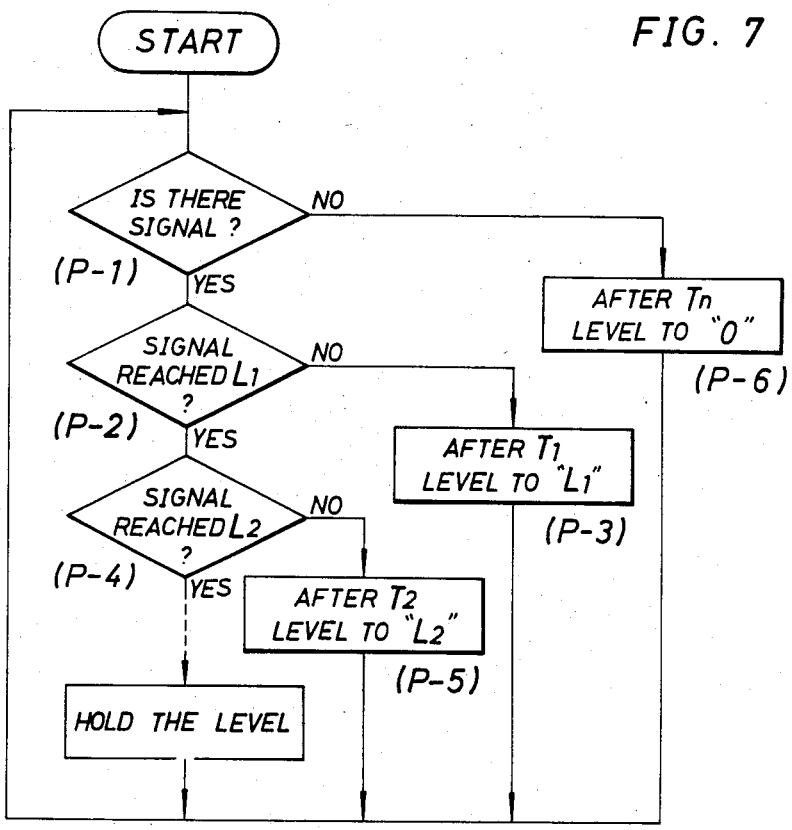
FIG. 7 is a flowchart describing the reading sequence of the data of waveforms stored in the waveform data memory.

FIG. 7 shows how waveform data is read out. A decision is made as to whether a trigger signal appears or not (P-1), and if the trigger signal is inputted, the signal appearing at the output terminal of the sound component pattern generator $PG_1$ is allowed to reach as high a level as $L_1$ (P-2), and the output level is allowed to rise high to the level $L_1$ for the length of time $T_1$ (P-3). Next, the signal appearing at the output terminal of the sound component pattern generator $PG_2$ is allowed to reach as high a level as $L_2$ (P-4), and the output level is allowed to rise high to the level $L_2$ for the length of time $T_2$ (P-5). So far as the trigger signal TS remains, the subsequent sound component pattern generators are allowed to provide their output signals, allowing the signal level to diminish to zero in time Tn when the trigger signal ends. The embodiment described above uses a microprocessor, permitting the easy synthesis of complicated waveform according to which different softwave is employed. However, processing is disadvantageously performed at a relatively reduced speed. In this connection sound component pattern generators may be preferably made up in the form of hard logic circuits for exclusive use.

As described earlier, digital signals after being taken out of the waveform data memory 2 and after being outputted by the selective reading out circuit 3, are converted to analog signals by a D/A converter 4. In case thirty-two sound component pattern generators are used, the period of the analog signal is composed of thirty-two divisions, and the analog signal accompanies an appreciable coarseness, containing the forty-eighth or higher harmonics. If these harmonics are below four hundred hertz, these noises are audible, causing disturbance in the ears. In this connection it is necessary to eliminate such fortyeighth harmonics by a low-pass filter 5. It is possible that an analog signal composed of thirty-two divisions contains controllable harmonics up to the sixteenth. Therefore, the cut-off frequency of the low-pass filter 5 is ideally above sixteen times the fundamental wave, and the diminishing factor is at an increased value for the forty-eighth or higher harmonics. A voltage-controlled variable frequency filter (VCF) is appropriate for the purpose, although expensive. Alternatively, the amplitude of data stored in the waveform data memory is increased at the rate of +6 dB/oct as the frequency rises, and the emphasis of the parameters is determined appropriately, and then a low-pass filter whose cut-off frequency is set at a relatively low frequency and whose diminishing factor is −6 dB/oct, permits constant diminishing irrespective of frequency and diminishing of higher harmonic at the rate of −6 dB/oct, thus decreasing the noises of the forty-eighth harmonics by −30 or more dB.

In the embodiment described above the waveforms of the sound component pattern generators show a linear variation. This should not be understood as limitative .

Curved waveforms may be provided by the sound component pattern generators. As is readily understood, the more the number of sound component pattern generators, the more the number of harmonics in the musical sounds. The sound source apparatus as described above is of digital structure. As a matter of course, an analog structure is possible.

As seen from the above, a sound source apparatus according to this invention is composed of a plurality of sound component pattern generators each capable of providing a predetermined pattern, and a sound component picking circuit for sweeping the plurality of sound component pattern generators repeatedly in such a rapid sequence that the sound component thus provided and taken may constitute a musical sound at a desired pitch. The sound component pattern varies with time divisions and levels of sound components. Therefore, a set of sound component patterns can be made up by adjusting these factors so as to simulate a desired tone, for instance, the one produced by a piano, and another set of sound component patterns can be made so as to simulate another desired tone, for instance, the one produced by a guitar. The increase of the number of factors in a sound component pattern will permit production of complicated tones by the sound source apparatus.

What is claimed is:

1. A sound source apparatus for generating a musical sound corresponding closely to a predetermined sound waveform, said predetermined sound waveform being divided into a plurality of parts separated in time, and wherein each of said parts has a plurality of phase points also separated in time, said sound source apparatus comprising a plurality of sound component pattern generators wherein the number of generators corresponds to the number of parts into which said predetermined sound wave has been divided, the waveform of the signal generated by each of said plurality of sound component pattern generators being derived from samples taken from a corresponding phase point of each part of said predetermined sound waveforms, the levels of the signals generated by each of said sound component pattern generators further varying with time in accordance with a predetermined pattern; and a sound component picking circuit coupled to the outputs of said plurality of sound component generators, said sound component picking circuit repeatedly sweeping in rapid sequence the output of said plurality of sound component generators, the output of said sound component picking circuit constituting a musical sound having a desired pitch.

2. A sound source apparatus according to claim 1, wherein said predetermined sound waveform is composed of sound components sampled from sequential waveforms corresponding to the attack, decay and release of a given sound wave at a predetermined phase point.

3. A sound source apparatus according to claim 1, wherein said sound component picking circuit includes means for controlling the rate at which the sweeping is conducted so as to determine the pitch of the resultant sound.

4. A sound source apparatus according to claim 1, wherein each of said sound component pattern generators is comprises a register for storing said predetermined sound waveform in a digital form.

5. A method of generating a musical sound corresponding closely to a predetermined sound waveform, comprising the steps of dividing each cycle of said predetermined sound waveform into a plurality of parts separated in time, each of said parts having a plurality of phase points also separated in time;

providing a plurality of sound component pattern generators, the number of said generators provided corresponding to the number of parts into which said predetermined sound wave has been divided;

generating a sound component pattern waveform at the output of each of said sound component pattern generators by sampling the levels at corresponding phase points of each of said parts of said predetermined sound waveform and producing said sound component pattern waveform by generating said sampled levels sequentially in time; and sweeping repeatedly the outputs of said sound component pattern generators whereby said musical sound is generated by the combined outputs of said plurality of sound component pattern generators.

* * * * *